US011612543B2

(12) United States Patent
Baker et al.

(10) Patent No.: US 11,612,543 B2
(45) Date of Patent: Mar. 28, 2023

(54) TEMPERATURE CONTROL CASE FOR MEDICAMENT

(71) Applicant: NOBLE INTERNATIONAL, INC., Orlando, FL (US)

(72) Inventors: Jeff Baker, Orlando, FL (US); Joseph Reynolds, Ocala, FL (US); Matthew Palyo, Orlando, FL (US); Shishuang Hou, NingBo (CN)

(73) Assignee: NOBLE INTERNATIONAL, INC., Orlando, FL (US)

( * ) Notice: Subject to any disclaimer, the term of this patent is extended or adjusted under 35 U.S.C. 154(b) by 249 days.

(21) Appl. No.: 16/761,430

(22) PCT Filed: Nov. 5, 2018

(86) PCT No.: PCT/US2018/059214
§ 371 (c)(1),
(2) Date: May 4, 2020

(87) PCT Pub. No.: WO2019/090224
PCT Pub. Date: May 9, 2019

(65) Prior Publication Data

US 2020/0390654 A1 Dec. 17, 2020

Related U.S. Application Data

(60) Provisional application No. 62/581,341, filed on Nov. 3, 2017.

(51) Int. Cl.

| | |
|---|---|
| ***A61J 1/16*** | (2006.01) |
| ***B65D 81/18*** | (2006.01) |
| ***B65D 81/38*** | (2006.01) |

(52) U.S. Cl.
CPC ..... *A61J 1/165* (2013.01); *B65D 81/18* (2013.01); *B65D 81/3813* (2013.01); *A61J 2200/44* (2013.01); *A61J 2200/50* (2013.01)

(58) Field of Classification Search
None
See application file for complete search history.

(56) References Cited

U.S. PATENT DOCUMENTS

| | | | | |
|---|---|---|---|---|
| 2003/0051502 | A1 | 3/2003 | Smith et al. | |
| 2008/0164265 | A1* | 7/2008 | Conforti | B65D 81/3823 220/592.2 |

FOREIGN PATENT DOCUMENTS

| | | |
|---|---|---|
| WO | 2012003543 | 1/2012 |
| WO | 2017083738 | 5/2017 |

OTHER PUBLICATIONS

PCT/US18/59214; International Search Report and Written Opinion, dated Feb. 4, 2019, 14 pages.

* cited by examiner

*Primary Examiner* — Adolf Dsouza
(74) *Attorney, Agent, or Firm* — Timothy H. Van Dyke; Wolter, Van Dyke, Davis, PLLC

(57) ABSTRACT

The invention pertains to a portable insulated medicament container that includes a housing defining a cavity for receiving medicament for maintaining temperature control of the medicament. The housing has an opening for accessing the cavity, and the housing further includes one or more cooling elements for placement in the cavity. The invention also pertains to a method for using a portable insulated medicament container to store a medicament at a temperature range to avoid damage to the medicament.

8 Claims, 16 Drawing Sheets

TEMPERATURE CONTROL CASE FOR MEDICAMENT

BACKGROUND

There are a number of medicaments that require temperature regulation to maintain their efficacy. Some of these medicaments must be transported from one place to another for administration to a user at a certain time. During transportation of these medicaments the temperature of the medicament must remain at a certain level in order to preserve the efficacy of the medicament. If the medicament temperature falls below a certain low threshold level, or increases above a certain high threshold level, the medicament may no longer function as intended in the user. Consequently, it is of utmost importance to monitor the temperature of a medicament up until the time of administration thereof.

Portable insulated containers are known to maintain contents at a cold temperature for a period of time. Prior art containers typically include hard or soft body construction, and one or more cooling units, which may often include ice, disposed therein to cool the contents of the container for a limited amount of time by transferring heat energy between the ice and the product.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1:
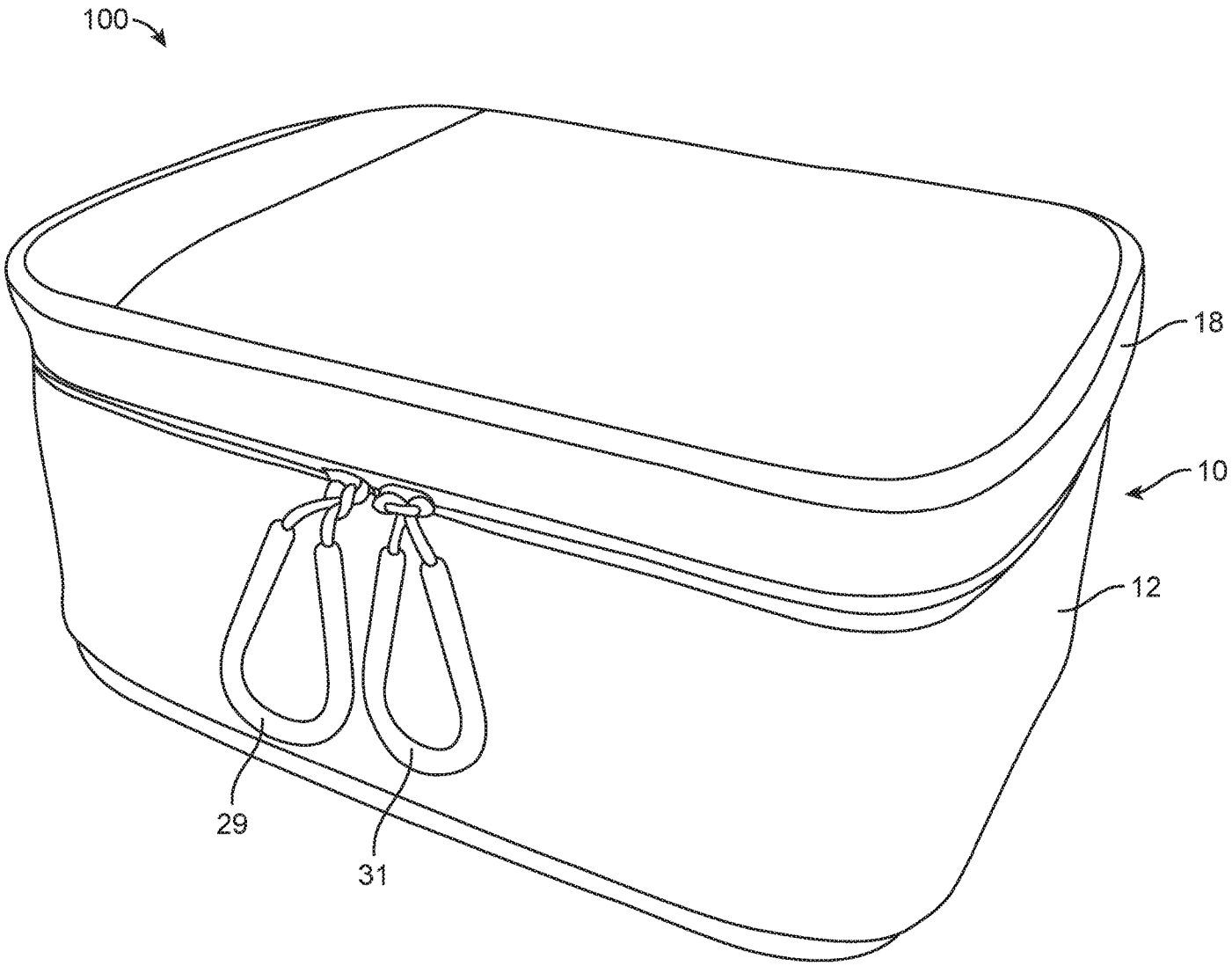
FIG. 1 is a front perspective view of an embodiment of a portable insulated medicament container.

For the purposes of promoting an understanding of the principles and operation of the invention, reference will now be made to the embodiments illustrated in the drawings and specific language will be used to describe the same. It will nevertheless be understood that no limitation of the scope of the invention is thereby intended, such alterations and further modifications in the illustrated container and method, and such further applications of the principles of the invention as illustrated therein being contemplated as would normally occur to those skilled in the art to which the invention pertains.

It is to be noted that the terms "first," "second," and the like as used herein do not denote any order, quantity, or importance, but rather are used to distinguish one element from another, unless otherwise specifically stated herein. The terms "a" and "an" do not denote a limitation of quantity, but rather denote the presence of at least one of the referenced item. The modifier "about" used in connection with a quantity is inclusive of the stated value and has the meaning dictated by the context. Furthermore, to the extent that the terms "including," "includes," "having," "has," "with," or variants thereof are used in either the detailed description and/or the claims, such terms are intended to be inclusive in a manner similar to the term "comprising."

It is to be noted that all ranges disclosed within this specification are inclusive and are independently combinable. Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. As a non-limiting example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 7.

The term "freezing unit" as used herein may refer to a machine for maintaining a temperature at least below 40 degrees Fahrenheit, more particularly, for maintaining a temperature below zero degrees Fahrenheit, for example, a freezer.

The term "medicament" as used in describing the various embodiments of this invention includes an injectable liquid medicine, medication, drug, pharmaceutical, vaccine, prescriptive, agent, antidote, anti-venom, hormone, stimulant, vasodilator, anesthetic, nutritional supplement, vitamin and/or mineral compound, saline solution, biological, organic compound, genetically and/or chemically modified protein and/or nucleic acids, or other liquid that is adapted to be injected into the tissue of a subject.

The term associated or association, as used herein, includes but is not limited to direct and indirect attachment, adjacent to, in contact with, partially or fully attached to, and/or in close proximity therewith. The term "in conjunction with" as used herein includes but is not limited to synchronously or near synchronous timing, the phrase may also include the timing of outputs, where one output directly follows another output.

As used herein, the terms "subject", "user" and "patient" are used interchangeably. As used herein, the term "subject" refers to an animal, preferably a mammal such as a non-primate (e.g., cows, pigs, horses, cats, dogs, rats etc.) and a primate (e.g., monkey and human), and most preferably a human.

As used herein, the term "efficacy" refers to the capacity for sufficient therapeutic effect or beneficial change in a patient in a clinical setting, for example, for a given intervention. Efficacy refers to the minimum threshold required to achieve a positive effect in a patient.

The inventors have discovered herein a new and useful portable insulated medicament container for maintaining a medicament at a predetermined temperature to comply with the medicament instructions for use (IFU) and/or to prevent medicament expiration, and provide for a means for traveling with a medicament without access to refrigeration. The efficacy of medicaments which are required to be kept at temperatures between 2-8 degrees Celsius, for example, depends on the medicament being maintained within the temperature range indicated for the particular medicament. Achieving this objective is often difficult when doses must be delivered to a user throughout the day, and accessibility to a refrigerator or freezer is not always possible. Furthermore, many cooling packs for holding medicament either: 1) do not maintain the medicament within the required predetermined range, and/or 2) require a warming or normalization period between removal of the cooling pack from a cooling environment such as a freezer, for example, and prior to placement of the medicament within the cooling pack, therefore increasing the wait time prior to departure in order to avoid over-cooling, or possibly freezing the medicament rendering it inactive or less effective. Further, overly cooled or frozen medicament is quite painful to administer by way of parenteral administration; and therefore, temperature regulation of medicament is not only crucial for maintaining the stability of the medicament, but also for patient comfort.

The described normalization period has been the standard in the industry, requiring users to specifically follow the instructions preventing the insertion of the medicament into the cooling pack immediately upon removal of the cooling pack and/or the cooling elements within the cooling pack from the cooling environment. Typically, the prescribed normalization period extends 20 minutes from removal of the cooling pack or container from the cooling environment, and prior to disposing the medicament device into the container. Problems which may be encountered with these prior art cooling packs or containers which require the warming, or normalization period before use include risk of cooling the medicament below recommended temperature risking destroying the efficacy of the medicament by inserting the medicament into the cooling pack prior to completion of the normalization (wait) time as aforementioned, or the inconvenience associated with waiting to place the medicament into the cooling pack until the typically-required 15-20 minutes following removal of the pack or the cooling units from the cooling environment.

Oftentimes, users are unaware of the required normalization period or wait time, or are in a hurry, and therefore place the medicament device into the container prior to completion of the normalization period/warming period. Therefore, in embodiments herein, the term "warming period or "normalization period" in reference to the container or cooling elements includes a time period defined as between removal of the container and/or the cooling elements from a cooling environment, and prior to placement of a medicament device into the container containing the cooling elements.

Figure 2:
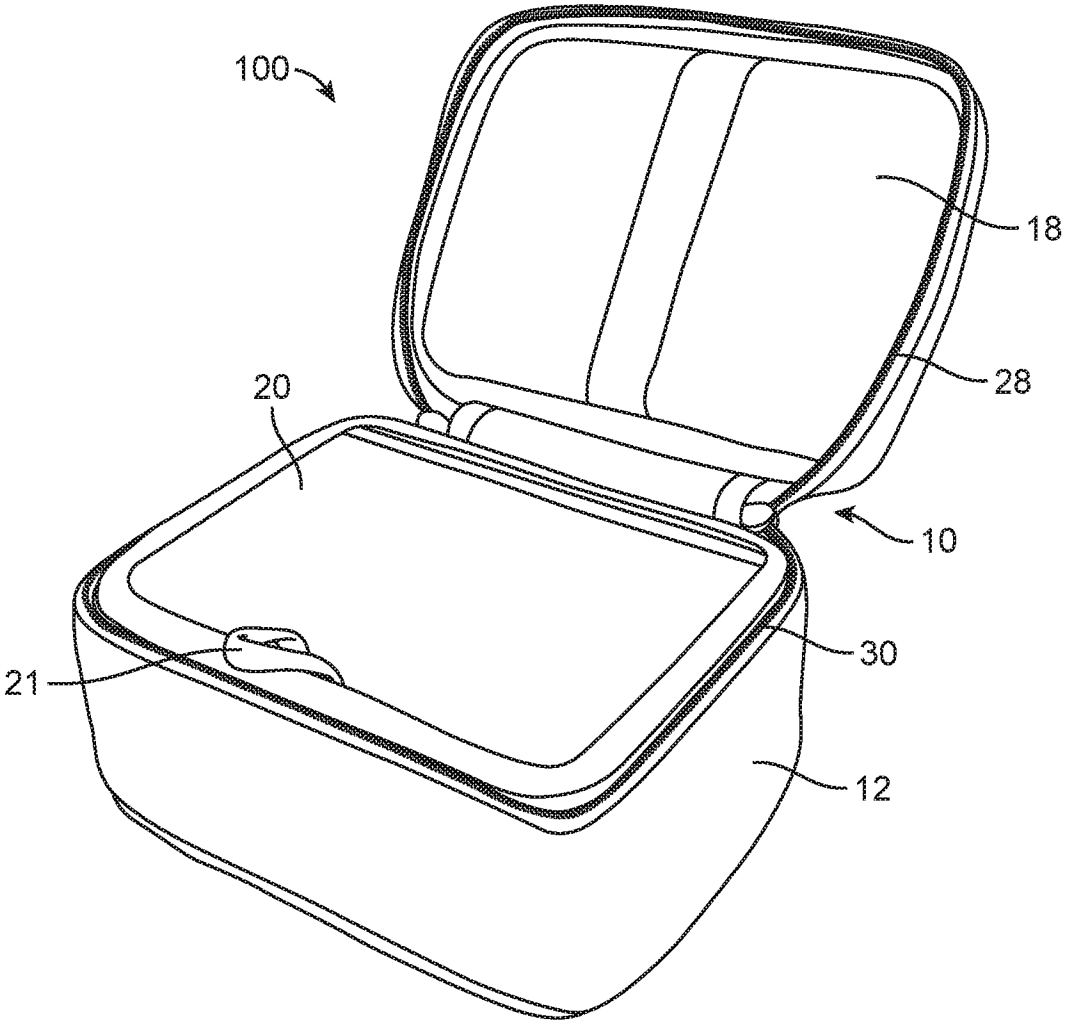
FIG. 2 is a front perspective view of the embodiment of the portable insulated medicament container shown in FIG. 1, wherein a lid component of the container is in an open position.
Figure 3:
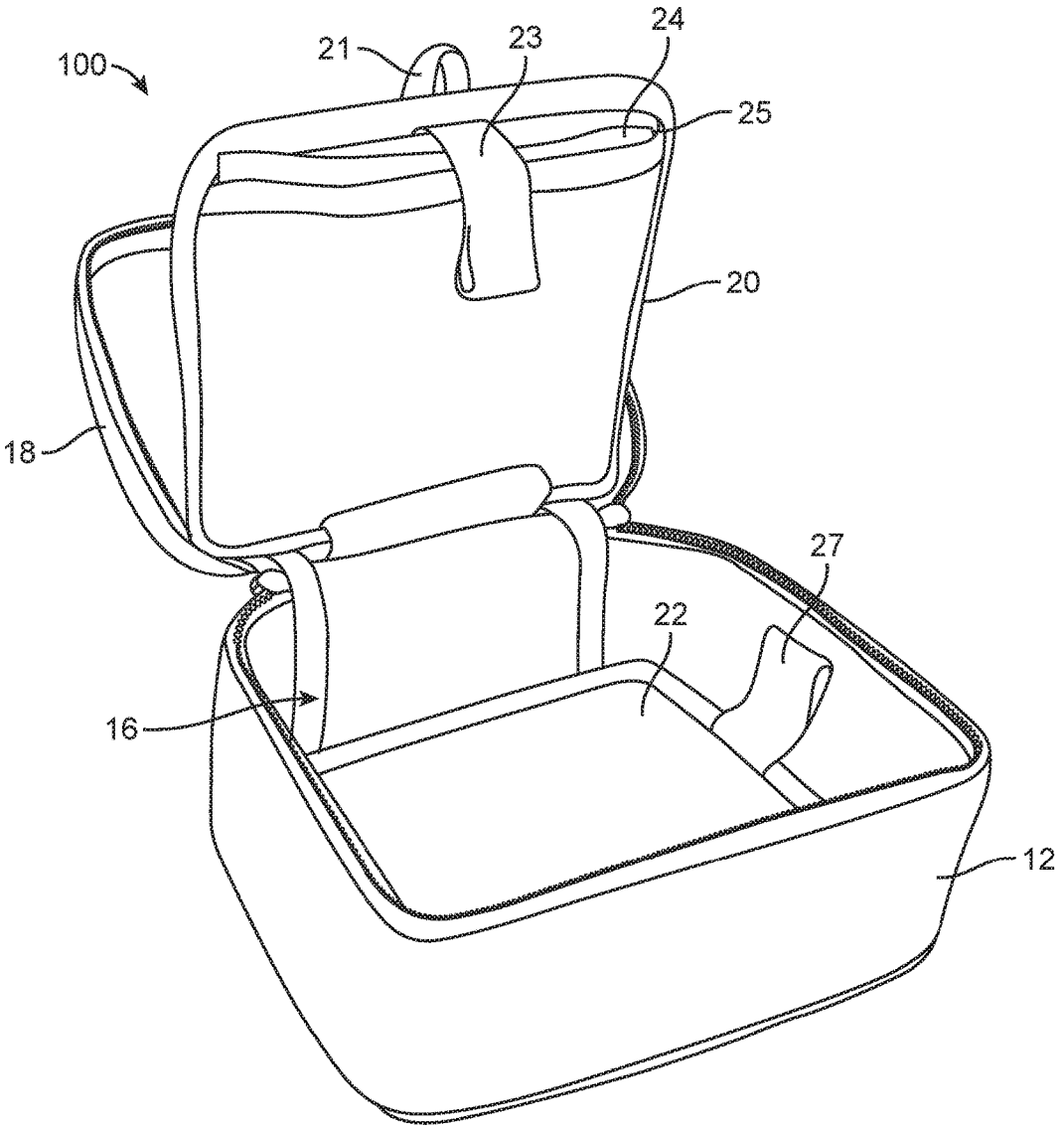
FIG. 3 is a front perspective view of the embodiment of the portable insulated medicament container shown in FIG. 1, wherein at least one upper surface retaining component associated with a lid component and a cavity of the container is visible.
Figure 4:
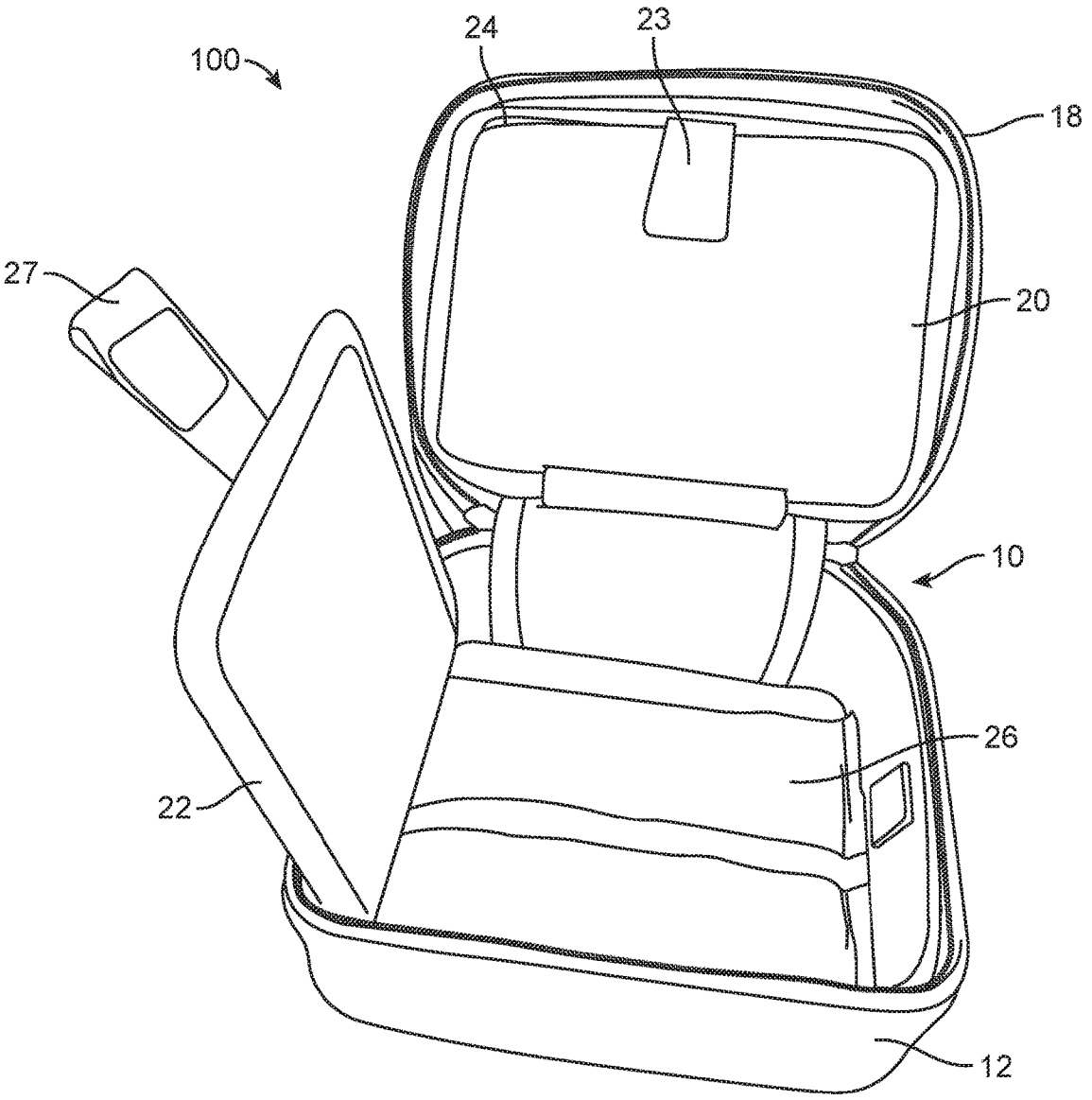
FIG. 4 is a front perspective view of the embodiment of the portable insulated medicament container shown in FIG. 3, wherein the lid component is opened exposing the cavity, and the at least one lower surface retaining component is displaced.

In one non-limiting embodiment, as shown in the front perspective view of FIGS. 1-4, a portable insulated medicament container 100 including a housing 10, having side walls 12 and a bottom portion 14 (bottom portion 14 shown in FIG. 9) that define a cavity 16, is provided. The container 100 further includes a lid component 18 pivotably connected with the housing 10, in one non-limiting embodiment. FIG. 2 shows the lid component 18 in an open position relative to the side walls 12. The container 100 further includes at least one upper surface retaining component 20 associated with the housing 10, and in some instances as shown in FIG. 2, associated with the lid component 18. FIGS. 2-4 further show at least one lower surface retaining component 22 associated with at least one side wall 12 shown in FIGS. 3-4. The at least one upper surface retaining component 20 can be manipulated with the at least one upper surface retaining component tab 21, for example. The at least one upper surface retaining component 20 can retain at least one first cooling element 24. In the embodiment shown in FIG. 3, the at least one first cooling element 24 may be disposed within a pocket 25 of the upper surface retaining component 20. The pocket 25 may be securable with a pocket flap 23, in a non-limiting embodiment as shown. In other non-limiting embodiments, the at least one first cooling element 24 may be disposed between the lid component 18 and the at least one upper surface retaining component 20, such that it is retained between the two components 18, 20.

As shown in FIG. 4, at least one second cooling element 26 may be retained by the at least one lower surface retaining component 22, which is pivotally associated with at least one side wall 12 as shown in FIGS. 3-4. The at least one second cooling element 26 is retained between the at least one lower surface retaining component 22 and the bottom portion 14 (not visible in FIG. 4). As shown in FIG. 3, the at least one lower surface retaining component 22 includes a lower surface retaining component tab 27 which may be used to selectively lift or lower the lower surface retaining component 22 to manipulate the at least one second cooling element 26 as necessary, for removal or placement of the at least one second cooling element 26 between the bottom portion 14 and the at least one lower surface retaining component 22.

In one non-limiting embodiment, the at least one second cooling element 26 may be disposed between the bottom portion 14 of the housing 10, and the at least one lower surface retaining component 22 as shown in FIG. 4. However, in another non-limiting embodiment, the at least one lower surface retaining component 22 may include one or more pockets for receiving one or more second cooling elements 26. The housing 10, lid component 18, upper surface retaining component 20, and lower surface retaining component 22 are configured so as to receive a medicament device between the at least one first cooling element 24 and the at least one second cooling element 26. In a further non-limiting embodiment, more specifically, the medicament device is to be received between the upper surface retaining component 20 and the lower surface retaining component 22, within the cavity 16. The arrangement of the portable insulated medicament container 100 provides the most effective cooling capability and temperature control for the medicament contained within the cavity 16. In a further non-limiting embodiment, the container 100 may be specifically structured to receive a medicament device within its original packaging, therefore not requiring removal of the medicament device from the packaging prior to placement of the medicament device into the cavity 16 of the container 100.

In a further embodiment, the container 100 may include a first zipper component 28 disposed on a periphery of the lid component 18 and a second zipper component 30 disposed on a periphery of the side walls 12 that is reciprocal to the first zipper component 28 such that the first and second zipper components 28, 30 zip together by manipulating one or more zipper tags 29, 31, to seal the lid component 18 onto the housing 10, in one example. In other non-limiting embodiments, different attachment mechanisms may be used in place of or in addition to the zipper components provided, such as, for example, a hook and loop attachment between the lid component and the side walls to secure the lid component to the side walls and enclose the cavity 16. In a further embodiment, the container 100 may maintain the temperature of the medicament placed within its cavity 16 between 0-10 degrees Celsius (i.e., maintained temperature), more preferably between 2-8 degrees Celsius, following reaching an internal temperature as low as 10 degrees Celsius, (i.e., an initial temperature $T_i$, in one example), and following removal of the medicament and/or of the container and/or of the cooling elements from the cooling environment. The container may maintain the initial temperature $T_i$ between 0-10 degrees Celsius for at least 2 hours. In some non-limiting embodiments, the container 100 may maintain the temperature of a medicament stored there within between 2-8 degrees Celsius for at least 2 hours. The temperature of the medicament, within 0-10 degrees or 2-8 degrees Celsius may be maintained for at least 6 hours.

In another non-limiting embodiment, the at least one first and/or second cooling elements 24, 26 are removable from the housing 10. In this manner, the cooling elements 24, 26 may be cooled to a desire temperature by placement within a cooling environment, without placing the container 100 in the cooling environment. In other embodiments, the container 100 containing the cooling elements 24, 26 may be placed in the cooling environment.

In a further non-limiting embodiment, the housing 10 may include dimensions of 5-15 inches×3-8 inches×0.5-6 inches, in one non-limiting example, or having a volume between 7.5 $in^3$ and 720 $in^3$ and the housing may include an R value of at least 1 (ft^2×° F.×hr.)/Btu. In one particular, non-limiting embodiment, the housing may include dimensions of 8.3×6.3×3.3 inches, and a volume of 172 $in^3$. In a non-limiting embodiment, the container housing 10 may include a minimum R value of 1.3 (ft^2×° F.×hr.)/Btu. The insulative materials having R values described herein may provide the container embodiments with a cooled temperature range of 0-10 degrees Celsius for at least six (6) hours in an ambient room temperature environment, in one non-limiting embodiment. In one non-limiting example, this ambient room temperature may include between 20-30 degrees Celsius. The R values described herein may take into consideration the thermal insulating properties of the material and/or the thickness of the material(s) layer(s) of the housing. These properties, in combination, provide for maintaining a medicament within the container between 0-10 degrees C., and in a further non-limiting embodiment, between 2-8 degrees C. In other non-limiting embodiments, the medicament holding unit may include an R value of at least 1.

In one non-limiting embodiment, the housing 10 may include a single layer, and may be formed of at least a first layer. In another embodiment, the housing 10 may include a multi-layer housing 10 and may be formed of at least a first layer and a second layer. In one particular embodiment, the first and second layers may include an outside layer and an inside layer, wherein said outside layer comprises a woven fabric, and wherein said inside layer comprises a fluid impermeable or fluid resistant material. In a further embodiment, the container 100 may include an insulating material disposed between the outside layer and the inside layer. In a more specific embodiment, at least a portion of the housing 10 may include a polystyrene material.

In another non-limiting embodiment, a method for using a portable insulated medicament container 100 embodiment is provided. The method includes cooling the portable insulated container 100 in a cooling environment, removing the portable insulated medicament container 100 from the cooling environment, and placing a medicament device containing a medicament in the cavity 16 of the portable insulated medicament container 100 to maintain the medicament within a predetermined temperature range. In one embodiment, the medicament device may be placed within the cavity 16 immediately upon removal of the container 100 from the cooling environment. In another non-limiting embodiment, the medicament may be placed into the container 100 within 1-15 minutes following removal of the container 100 and/or the cooling elements from the cooling environment. In yet another embodiment, the medicament device may be placed into the container 100 within 16-20 minutes following removal of the container 100 and/or the cooling elements from the cooling environment.

In an alternative embodiment, the cooling elements 24, 26, may be removed from the container 100 and placed in the cooling environment. The cooling elements 24, 26 may be placed into the container 100, the medicament device may be placed in the cavity 16, and the lid component 18 may be closed and sealed onto the side walls via zipper or other closure method, to enclose the cavity 16 of the container 100.

The portable insulated medicament container 100 may maintain the medicament stored in the cavity 16 within the predetermined temperature range for at least 2 hours. In another non-limiting embodiment, the container 100 will maintain the medicament stored within the cavity 16 within the predetermined temperature range for at least 6 hours. The predetermined temperature range of the medicament may include a range of 0-10 degrees Celsius. In another embodiment, the predetermined temperature range of the medicament may include between 2-8 degrees Celsius. In still a further embodiment, the portable insulated medicament container 100 may maintain a temperature of a medicament stored there within in the range of 0-10 degrees Celsius, or between 2-8 degrees Celsius in another embodiment.

Figure 5:
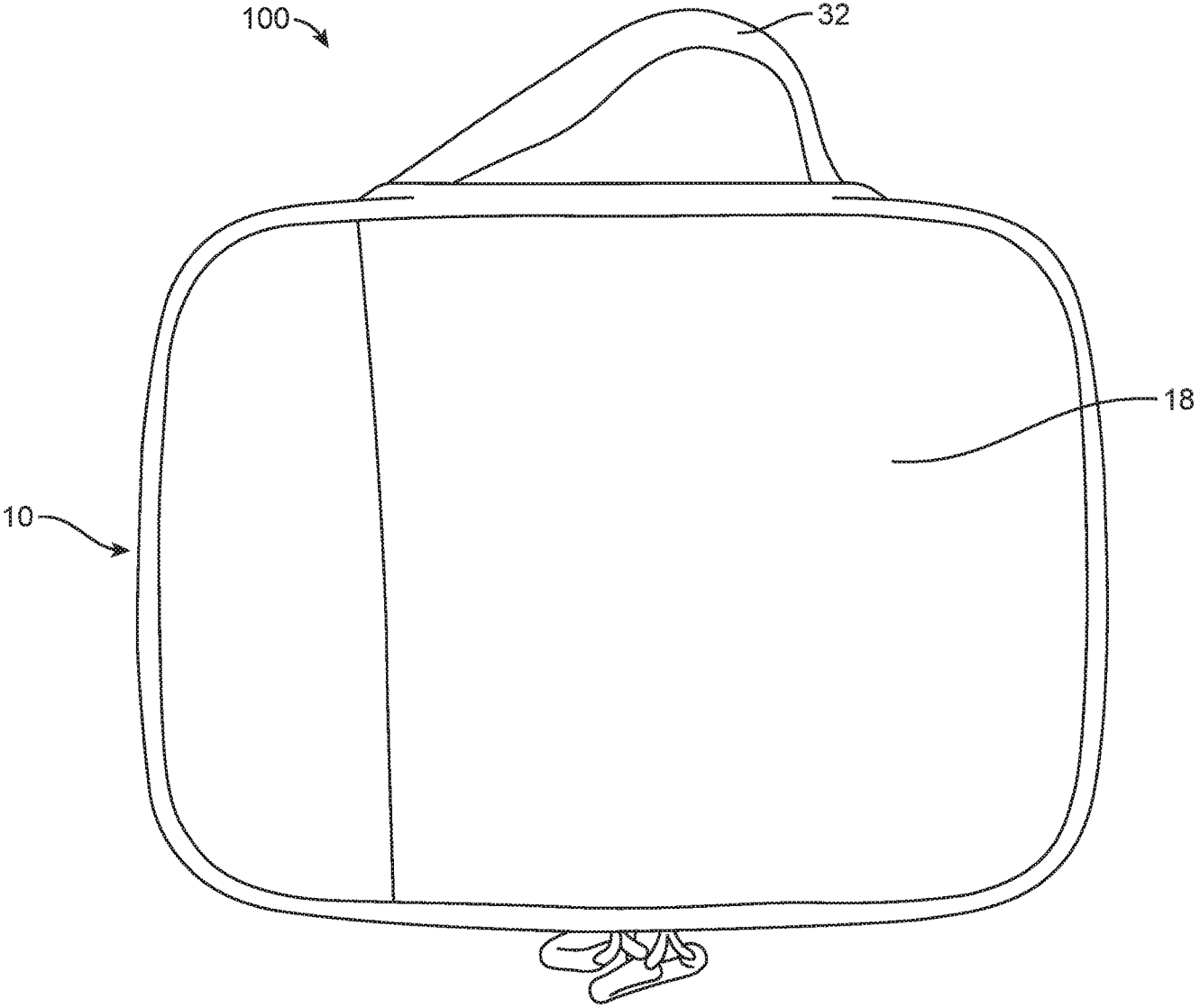
FIG. 5 is a top plan view of the embodiment of the portable insulated medicament container shown in FIG. 1.
Figure 6:
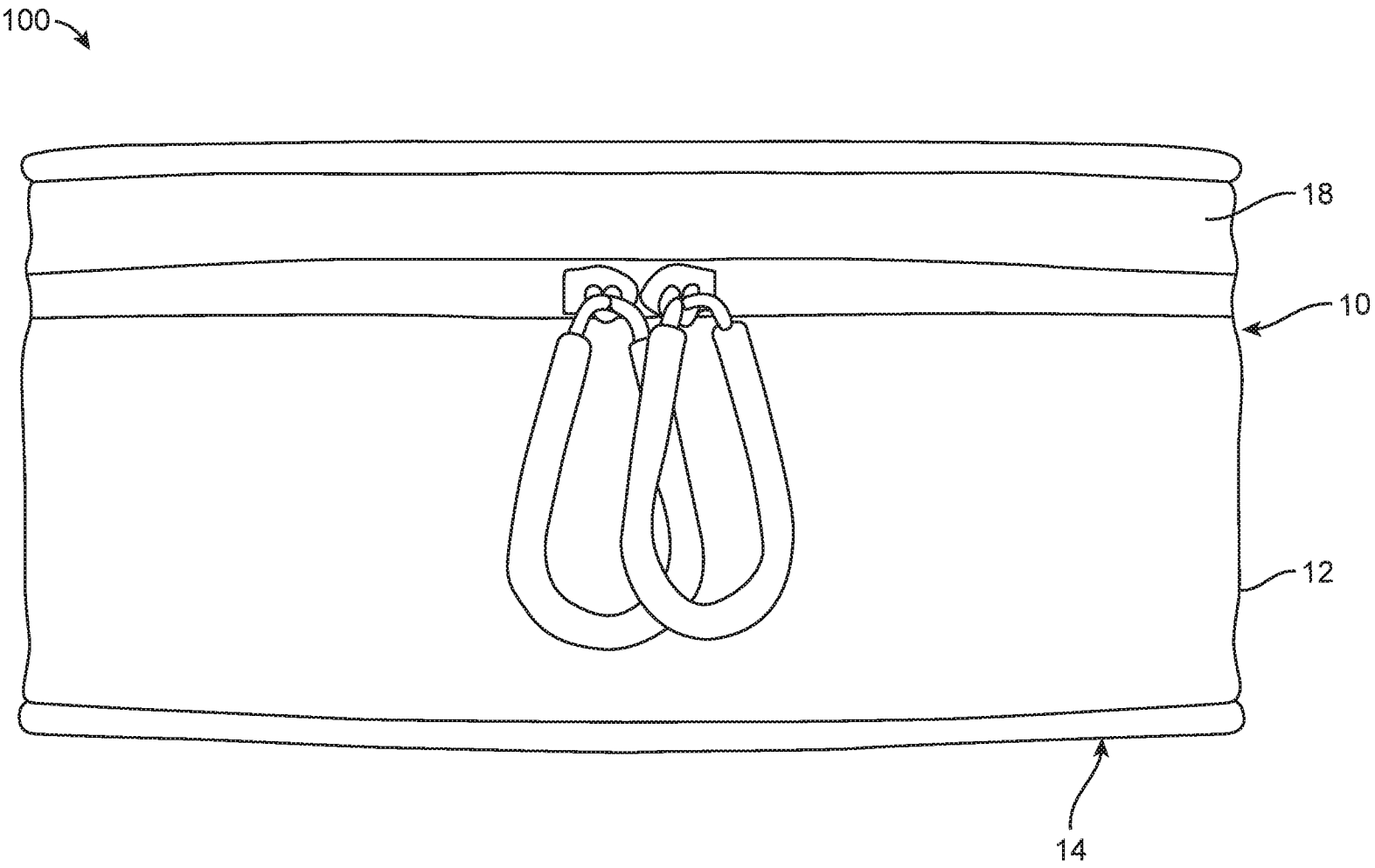
FIG. 6 is a front elevational view of the embodiment of the portable insulated medicament container shown in FIG. 1.
Figure 7:
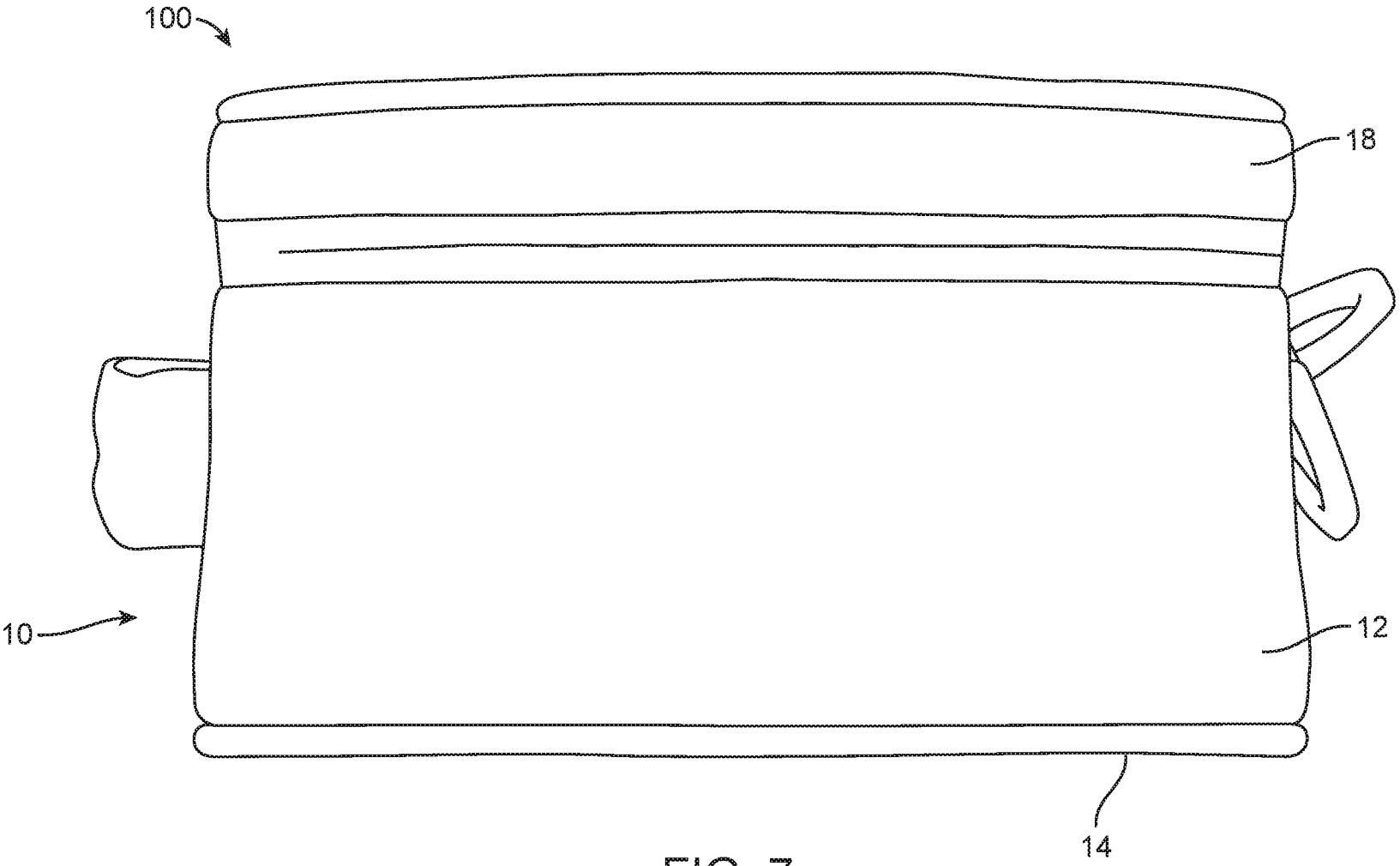
FIG. 7 is a back elevational view of the embodiment of the portable insulated medicament container shown in FIG. 1.
Figure 8:
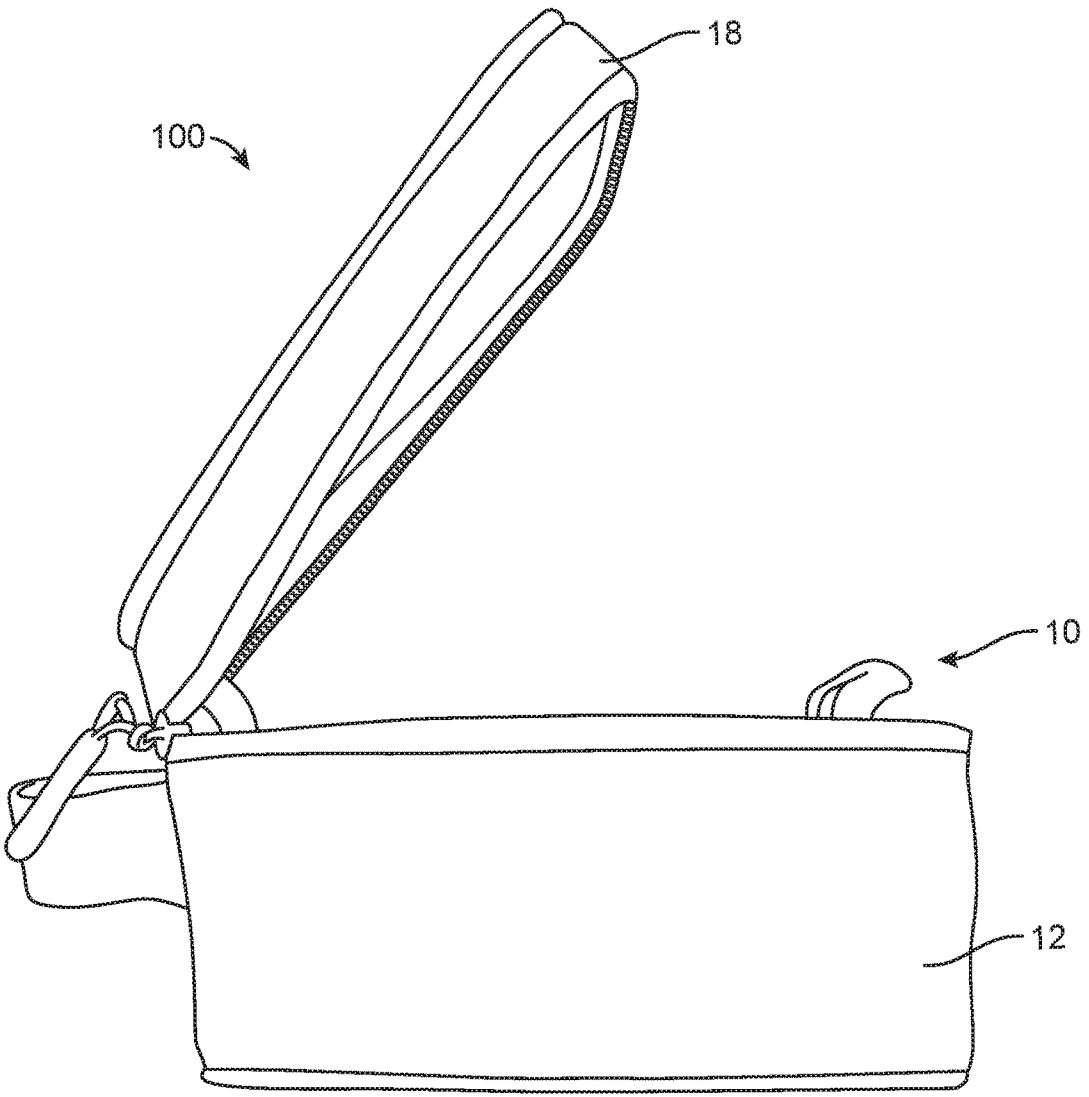
FIG. 8 is a side, elevational view of the embodiment of the portable insulated medicament container shown in FIG. 1.

The top plan view of the container embodiment 100 shown in FIG. 5 shows a carry handle 32 configured to carry the container 100 and shows a top view of the housing 10 with the lid component 18 in a closed position. The front elevational view of FIG. 6 and side view of FIG. 7 shows the container 100 housing 10 with the lid component 18 in a closed position relative to the side walls 12, joining between the lid component 18 and the bottom portion 14. The first and second zipper components 28, 30 (not shown in FIG. 6-7) are zipped together to seal the lid component 18 onto the side walls 12 to seal the cavity 16 (not shown in FIG. 6). FIG. 8 provides a side view of the embodiment 100 showing the housing 10 wherein the lid component 18 is in an open position relative to the side walls 12, exposing the at least one upper surface retaining component tab 21 of the at least one upper surface retaining component 20 located within the cavity 16 (not visible in FIG. 8).

Figure 9:
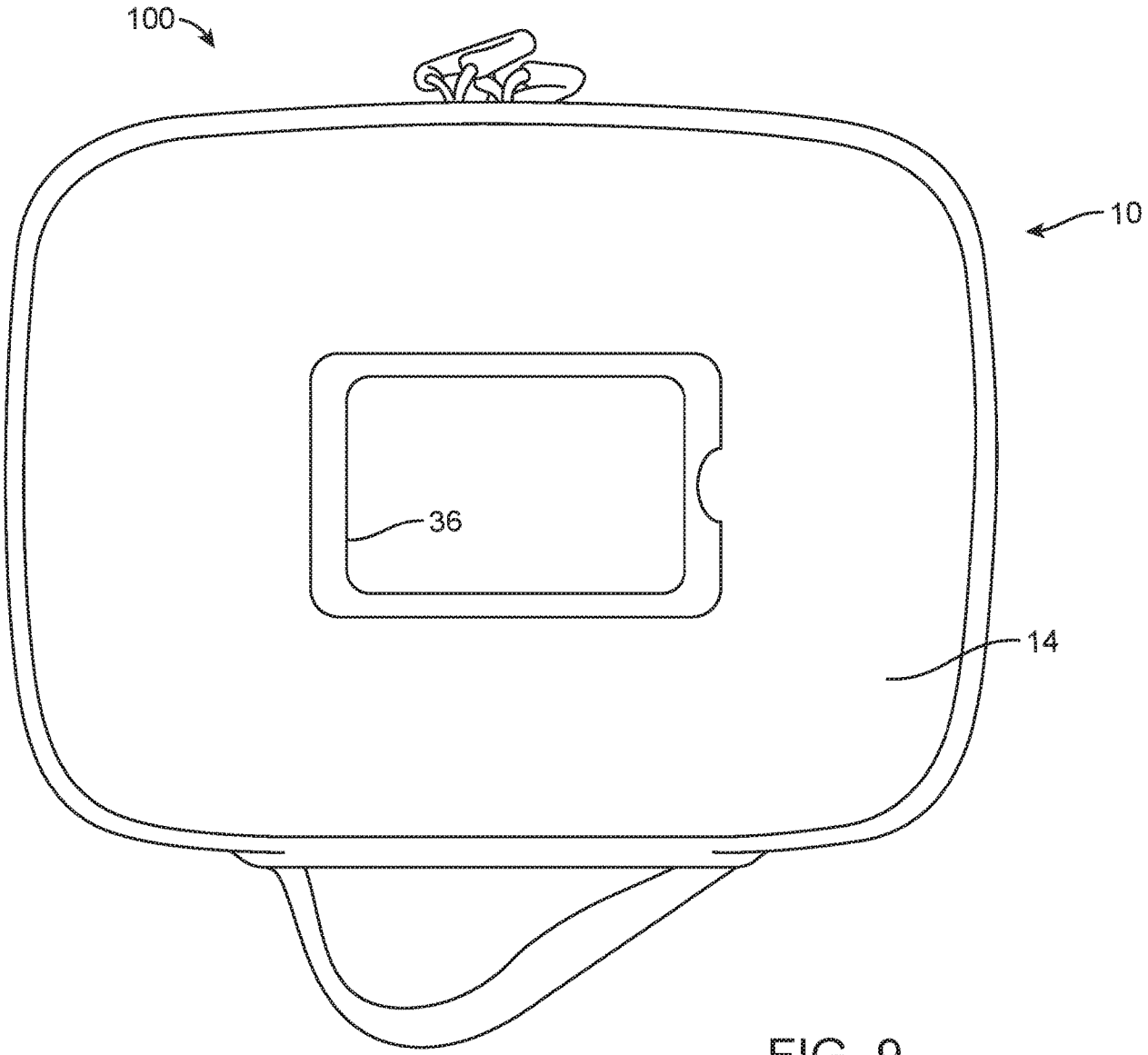
FIG. 9 is a bottom view of the embodiment of the portable insulated medicament container shown in FIG. 1.

In the bottom view of the embodiment 100 of FIG. 9, the bottom side 14 of the housing 10 is provided. An identification tag 36 may be provided on the housing 10, so as to identify the medicament device(s) stored within the container 100 or any patient or user information as necessary.

Figure 10A:
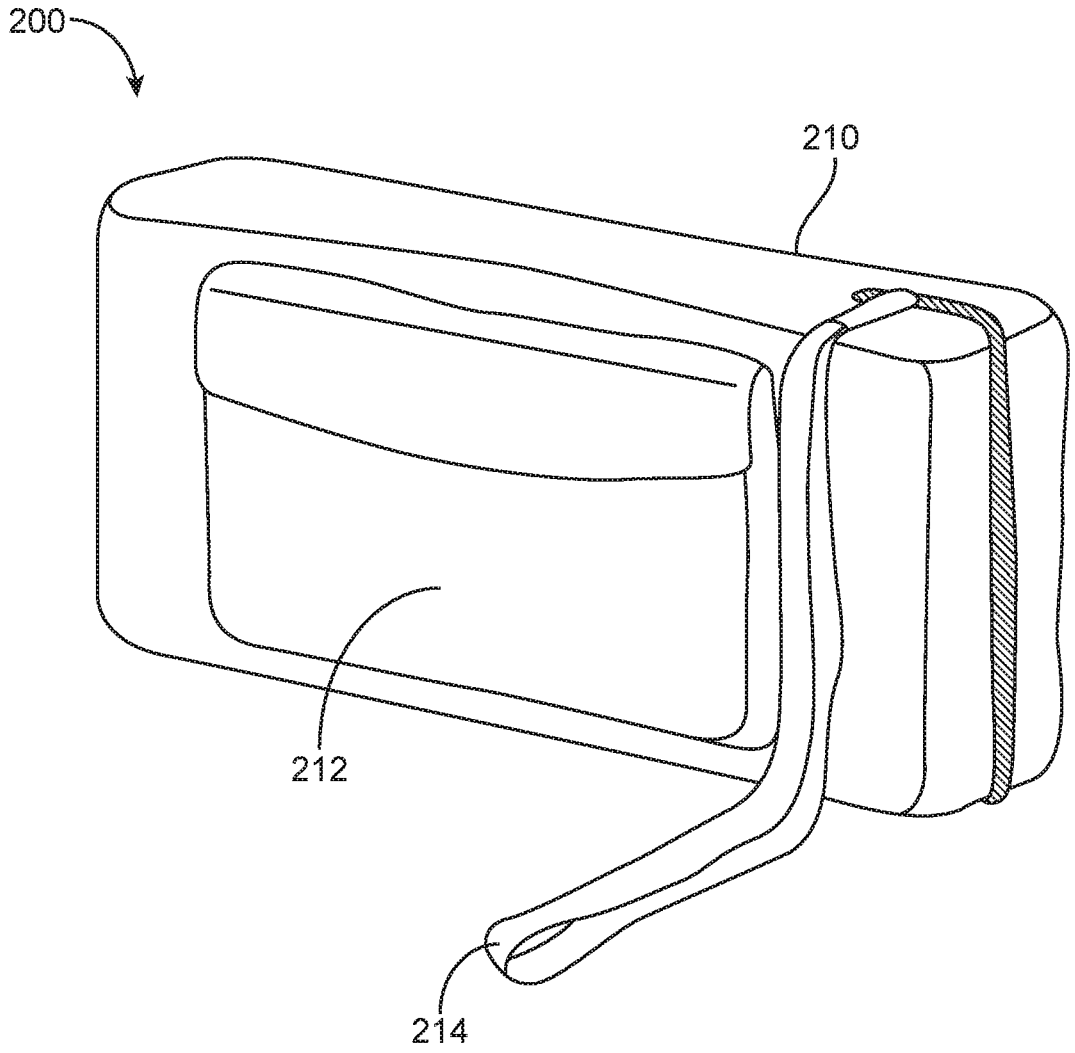
FIGS. 10A-C include perspective view of a portable insulated medicament container embodiment.

FIG. 10A is a perspective view of a portable insulated medicament container embodiment 200 including a housing 210, a pocket 212 for storing items, including, for example, instructions for using the device storable within the housing 210, and a carry handle 214.

Figure 10B:
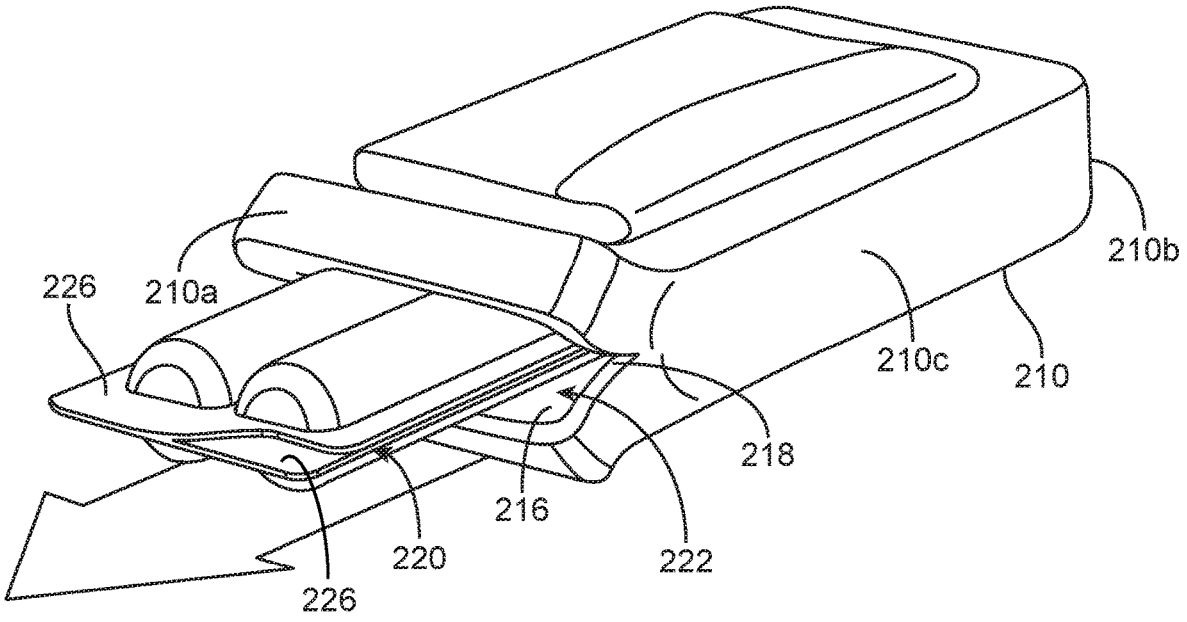
Figure 10C:
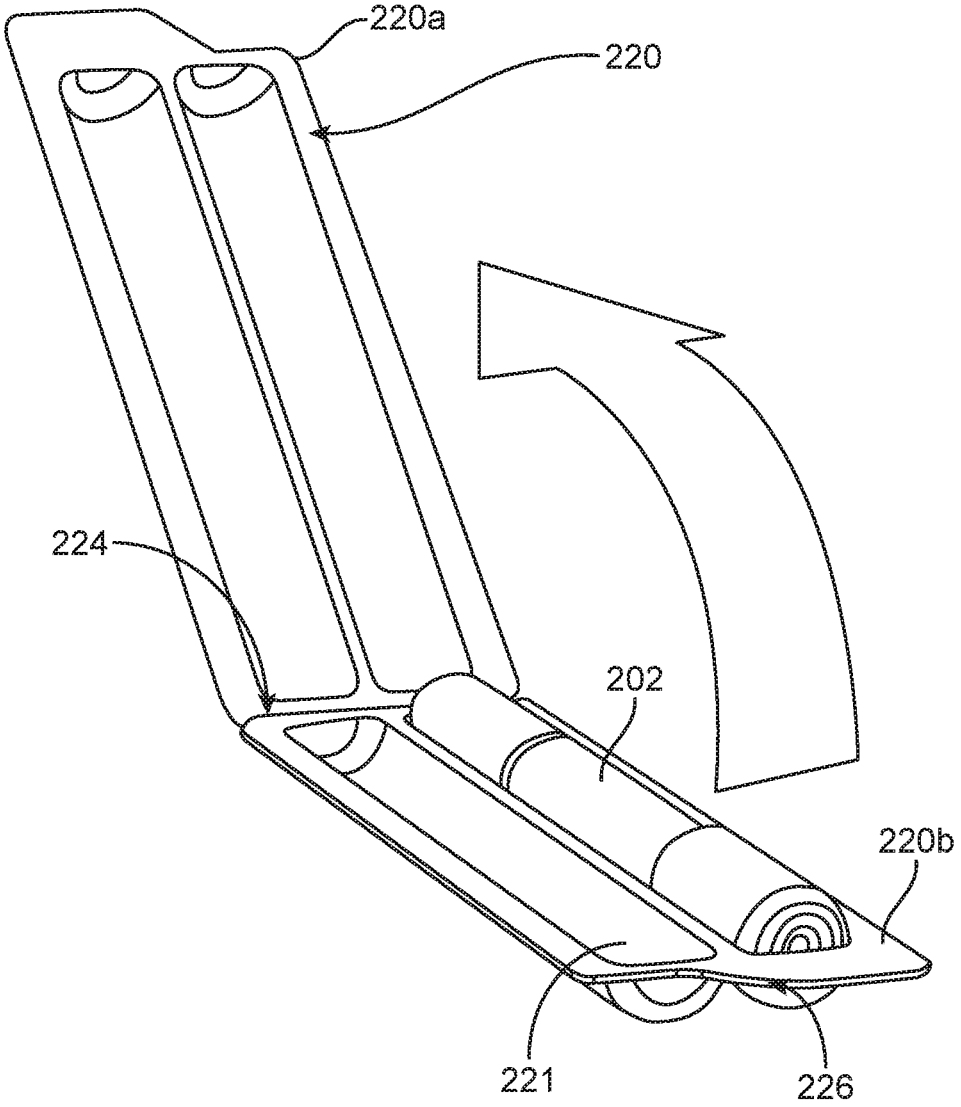

FIG. 10B provides a perspective view of the container embodiment 200 in an open position, wherein an opening 218 of the housing 210 is visible, in an open position, showing the cavity 216 there within. The housing 210 includes an upper portion 210*a* and a lower portion 210*b*, side walls 210*c*, which may be provided of insulating material, in one example. In place of a lid component as shown in other embodiments herein, the upper portion 210*a* of the housing may include a Zipper closure at the opening 218 for allowing access to the cavity 216, for example. A medicament holding unit 220 is disposable within the cavity 216. The medicament holding unit 220 may clip into or slide into the cavity 216 or be permanently affixed in the housing 210 within the cavity 216. As aforementioned, the medicament holding unit 220 may include a multitude of form factors, but in one non-limiting embodiment, the medicament holding unit 220 may include a capsule 228 for receiving a medicament device as shown in FIG. 10C. The medicament holding unit 220 may fully surround a medicament device 202 as shown in FIG. 10B or may only partially surround the medicament device. In the non-limiting embodiment of FIG. 10C, the medicament holding unit 220 comprises an upper portion 220*a* and a lower portion 220*b*, wherein the upper and lower portions 220*a* and 220*b* meet to encapsulate the medicament device 202, for example. The medicament holding unit 220 may include a snap closure to maintain the upper and lower portions 220*a*, 220*b* around the medicament device 202. In other non-limiting embodiments, the medicament holding unit 220 may include solely an upper portion 220*a* or a lower portion 220*b* for receiving the medicament device 202. The medicament holding unit 220 may be configured to receive more than one device 202, as is shown in FIG. 10C, though only one device 202 is shown disposed in the holding unit 220 in FIG. 10C. However, FIG. 10C shows a medicament holding unit 220 capable of receiving two medicament devices 202. The container 200 may further include at least one cooling element 222 as shown in FIG. 10B, which may be placed below or above the medicament holding unit 220.

When received within the medicament holding unit 220, and when the medicament holding unit is placed within the cavity 216, the medicament device 202 may be disposed within 0.2 centimeters-10 centimeters from the at least one cooling element. In yet another embodiment, the medicament device 202 may be disposed within 0.5-5 centimeters from the at least one cooling element when the medicament device 202 is received within the medicament holding unit chamber 221 inside the container 200. The medicament holding unit 220 may include a number of materials, and may be formed of polystyrene, or polyurethane, in non-limiting examples, for maintaining the medicament at a cooled temperature.

In another non-limiting example, the medicament holding unit 220 may be placed into a cooling environment prior to placement in the housing 210, and prior to receiving a medicament device 202, to maintain the medicament device 202 at a cooled temperature once received within the medicament holding unit 220. The medicament holding unit 220 may include one or more tabs 226 as shown in the non-limiting embodiment of FIGS. 10B-10C for selectively opening and closing the medicament holding unit 220 for allowing access to the one or more capsules 228 and the medicament devices 202 contained there within.

Figure 11A:
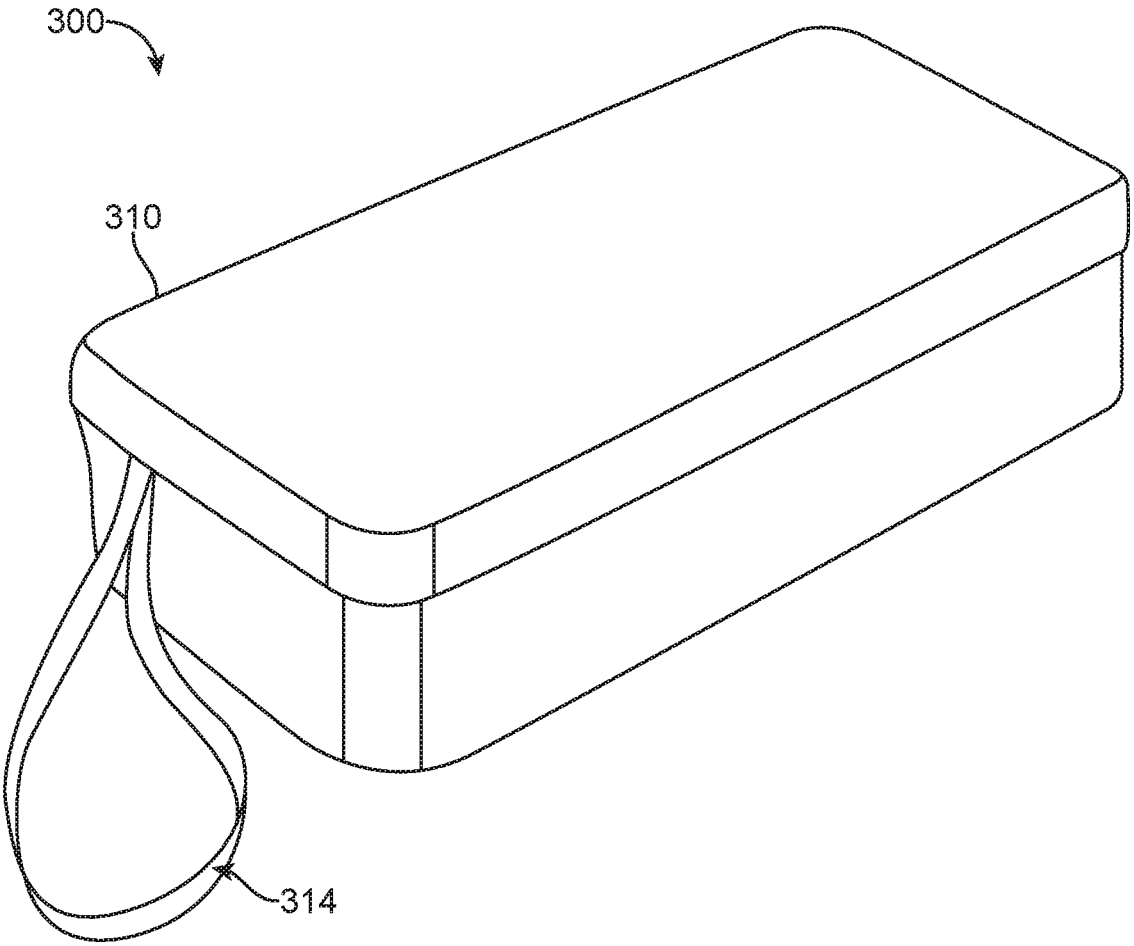
FIGS. 11A-B include another embodiment of a portable insulated medicament container, in perspective views, in a closed position and an open position.
Figure 11B:
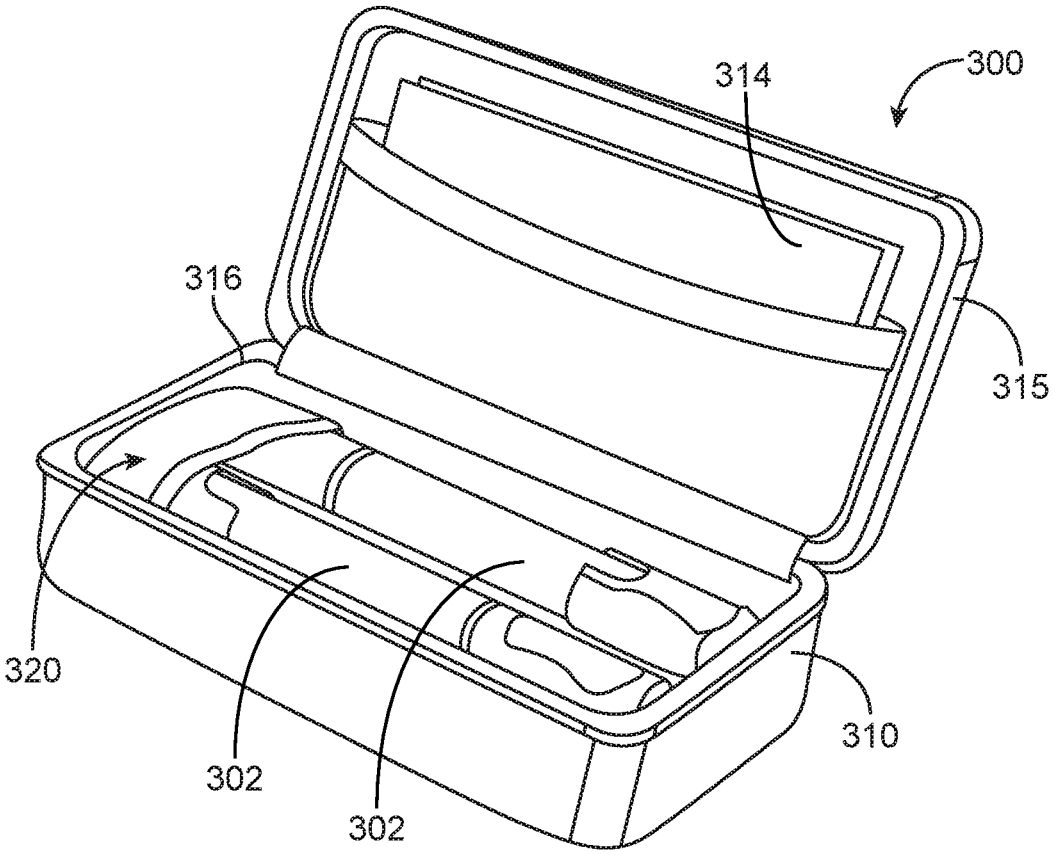

FIGS. 11A-B include perspective views of a portable insulated container embodiment 300 in a closed position (FIG. 11A) and in an open position (FIG. 11B). The container embodiment 300 may include a housing 310 and a carry handle 314. The embodiment 300 may further include a retaining strap 320 to maintain the medicament device within the cavity 316. A cooling element 322 may be disposed below the medicament devices 302 in the container embodiment 300. In a further non-limiting embodiment an additional cooling element 314 may be provided in a lid component 315 of the container 300.

Figure 12A:
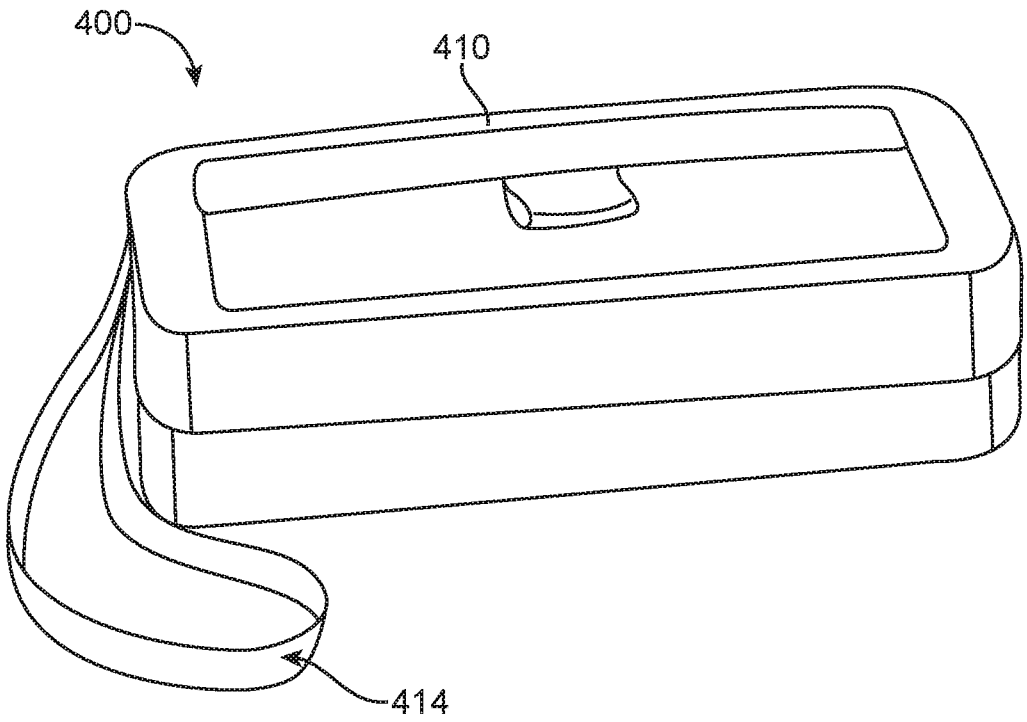
FIGS. 12A-B include yet a further embodiment of a portable insulated medicament container in perspective views, in a closed position and an open position.
Figure 12B:
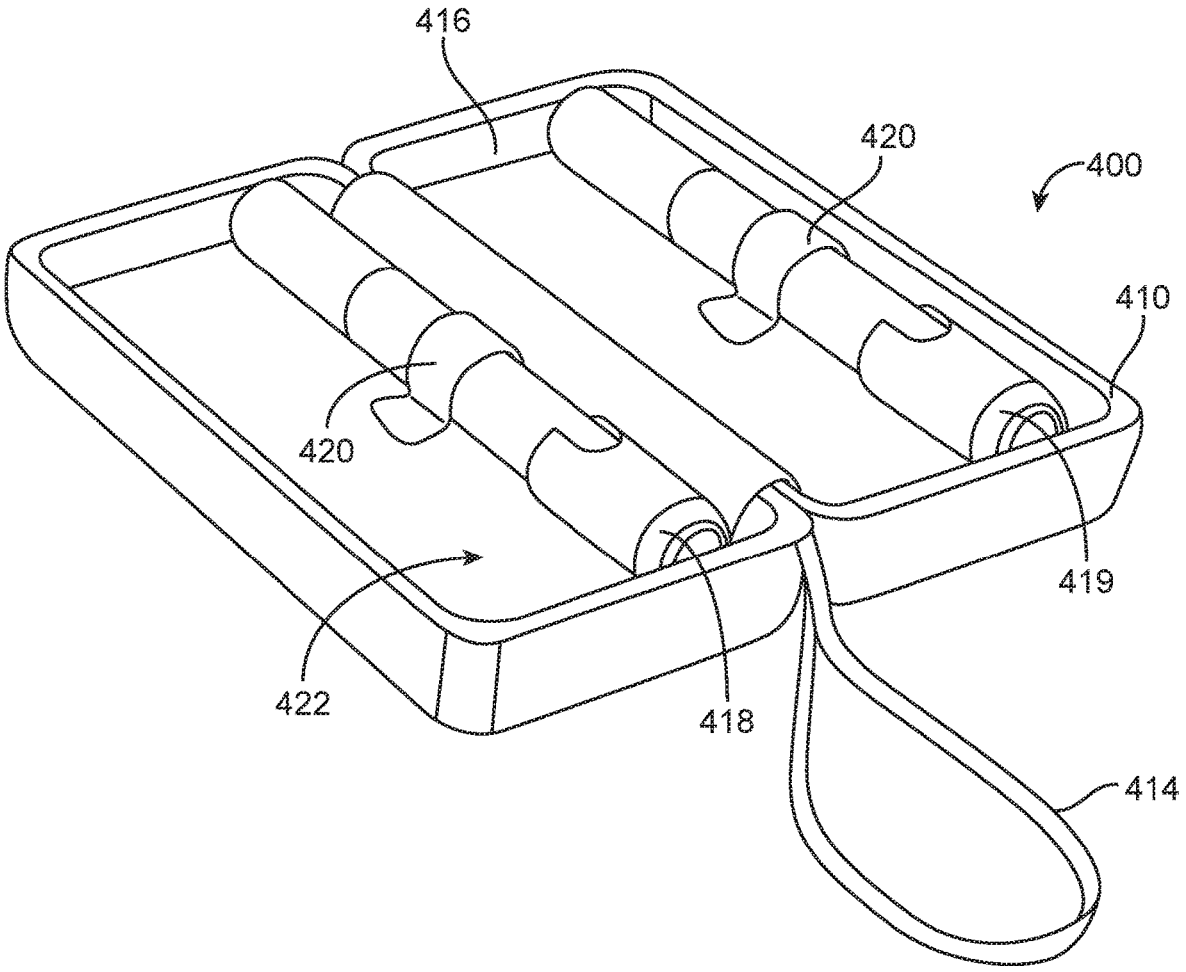

FIGS. 12A-B include perspective views of a portable insulated container embodiment 400 in a closed position (FIG. 12A) and in an open position (FIG. 12B). In the closed view, the housing 410 of the container 400 is shown, along with a carry handle 414 attached thereto. In the open position shown in FIG. 12B, the cavity 416 of the container 400 is shown with two medicament devices 418, 419 held there within. A first medicament device 418 and a second medicament device 419 are maintained in place within the cavity 416 by way of individual retaining straps 420. The retaining straps 420 may be formed of an elastic material in one, non-limiting embodiment, or may be affixed to the housing 410 by way of hook and loop closure, in another non-limiting embodiment, or by any other means known to those skilled in the art. One or more cooling elements 422 may be used in the container 400 to maintain the medicament device 418, 419 at a cooled temperature during use of the container 400. The cooling elements 422 may be disposed, for example, below the medicament device(s) 418, 419 as shown in FIG. 12B.

In yet a further non-limiting embodiment, a method for using a portable insulated medicament container for maintaining a medicament within a cooled temperature range ($T_r$) is provided. The cooled temperature range $T_r$ includes an initial temperature ($T_i$) whereby a medicament device containing a medicament is placed into the container without a warming period. The method may include removing a medicament device from a cooling environment, wherein the medicament has an initial temperature ($T_i$) between 0-10 degrees Celsius, removing either: 1) a container having a housing comprising side walls and a bottom portion that define a cavity, a lid component pivotably connected with the housing, at least one upper surface retaining component associated with the lid component for retaining at least one cooling element, at least one cooling element, a medicament holding unit disposed within the cavity for retaining a medicament device therein, and a sealing mechanism for sealing the lid component onto the housing, or 2) at least one cooling element for placement into the container, or both, from a cooling environment, and placing the medicament device in the container within 20 minutes of removing: 1) the container comprising the at least one cooling element, 2) the at least one cooling element, or both, from the cooling environment, in a non-limiting embodiment. In another non-limiting embodiment, the medicament device may be placed in the container within 10 minutes of removing the container and/or the cooling elements from the cooling environment. In still another non-limiting embodiment, the medicament device may be placed in the container immediately upon removing the container and/or the cooling elements from the cooling environment.

What is claimed is:

1. A portable insulated medicament container, comprising:

a housing comprising side walls and a bottom portion that define a cavity;

a lid component connected with the housing;

at least one upper surface retaining component associated with the housing and disposed between the lid component and the cavity, and at least one lower surface retaining component associated with at least one side wall for retaining at least one first cooling element, and at least one second cooling element, respectively, wherein the at least one first cooling element is retained by the at least one upper surface retaining component and the at least one second cooling element is retained by the lower surface retaining component; a medicament holding unit disposed within the cavity for retaining a medicament device therein, the medicament holding unit being comprised of a material comprising an R value sufficient to maintain the medicament between 0-10 degrees Celsius for at least six (6) hours, and a sealing mechanism for sealing the lid component onto the housing, wherein the housing is configured to receive a medicament between the first cooling element and the second cooling element, and wherein when the medicament is received within the medicament holding unit, the medicament is positioned between the first and second cooling elements and is disposed 0.2 centimeters-5 centimeters from the at least one first cooling element and/or at least one second cooling element.

2. The portable insulated medicament container of claim 1, further comprising a first zipper component disposed on a periphery of the lid component and a second zipper component disposed on a periphery of the side walls that is reciprocal to the first zipper component such that the first and second zipper components zip together to seal the lid component onto the housing.

3. The portable insulated medicament container of claim 1, wherein the container is configured to maintain medicament received there within between 2-8 degrees Celsius for at least 2 hours.

4. The portable insulated medicament container of claim 1, wherein the at least one first cooling element and the at least one second cooling element are removable from the housing.

5. The portable insulated medicament container of claim 1, wherein the housing comprises at least an outside layer and an inside layer, wherein said outside layer comprises a woven fabric, and wherein said inside layer comprises a fluid impermeable material.

6. The portable insulated medicament container of claim 5, further comprising an insulating material disposed between the outside layer and the inside layer.

7. A method for using a portable insulated medicament container, the method comprising:

cooling the portable insulated medicament container of claim 1, and/or cooling one or more removable cooling elements of the portable insulated medicament container in a cooling environment until the container and/or the cooling elements reach an initial temperature ($T_i$);

removing the portable insulated medicament container of claim 1 and/or the removable cooling elements from the cooling environment;

placing a medicament device containing a medicament in the cavity of the portable insulated medicament container to maintain the medicament within a predetermined temperature range for a predetermined time period;

wherein the medicament device is placed into the cavity upon removal of the container from the cooling environment, or upon removal of the cooling elements from the cooling environment and placement of the cooling elements into the container; wherein the predetermined temperature range comprises between 0-10 degrees Celsius for at least six (6) hours; and wherein the portable insulated medicament container is removed from the cooling environment at least 15 minutes prior to placement of the medicament device into the container.

8. A method for using a portable insulated medicament container for maintaining a medicament within a cooled temperature range ($T_r$), said cooled temperature range ($T_r$) comprising an initial temperature ($T_i$) whereby a medicament device containing the medicament is placed into the container without a container or cooling element warming period, the method comprising:

removing a medicament device from a cooling environment, wherein the medicament has an initial temperature ($T_i$) between 0-10 degrees Celsius;

removing either: 1) a container comprising a housing comprising side walls and a bottom portion that define a cavity, a lid component connected with the housing, at least one upper surface retaining component associated with the housing, and disposed between the lid component and the cavity, the upper surface retaining component for retaining at least one cooling element, at least one cooling element, a medicament holding unit disposed within the cavity for retaining a medicament device therein, and a sealing mechanism for sealing the lid component onto the housing, or 2) at least one cooling element for placement into the container, or both, from a cooling environment; and placing the medicament device in the container within 20 minutes of 1) removing the container comprising the at least one cooling element from the cooling environment, or 2) removing the at least one cooling element from the cooling environment and placing the at least one cooling element into the container wherein (i) the housing comprises a material having an R value sufficient to maintain the medicament between 0-10 degrees Celsius for at least six (6) hours;

(ii) the cooled temperature range ($T_r$) comprises between 2-8 degrees Celsius;

(iii) the medicament is maintained within the cooled temperature range ($T_r$) for at least 6 hours; (iv) the medicament device is placed into the container within 15 minutes of removing the medicament device from the cooling environment; (v) at least a portion of the housing comprises polystyrene and/or polyurethane, (vi) the medicament holding unit comprising polystyrene and/or polyurethane; and (vii) when the medicament is received within the medicament holding unit, wherein when the medicament is received within the medicament holding unit, the medicament is positioned between the first and second cooling elements and is disposed 0.2 centimeters-5 centimeters from the at least one first cooling element and/or at least one second cooling element.

* * * * *